United States Patent [19]

Steinbach

[11] 4,230,056

[45] Oct. 28, 1980

[54] AUTOMATIC THREAD WIPER FOR SEWING MACHINES

[75] Inventor: Irving H. Steinbach, Glen Rock, N.J.

[73] Assignee: Glen Manufacturing Company, Glen Rock, N.J.

[21] Appl. No.: 933,791

[22] Filed: Aug. 15, 1978

[51] Int. Cl.[3] ..... D05B 65/00; D05B 81/00

[52] U.S. Cl. ..... 112/239; 112/151; 112/286

[58] Field of Search ..... 112/237, 287, 286, DIG. 2, 112/DIG. 3, 239, 151

[56] References Cited

U.S. PATENT DOCUMENTS

| | | | |
|---|---|---|---|
| 2,703,542 | 3/1955 | Goldsmith | 112/151 |
| 2,988,031 | 6/1961 | Reid | 112/286 X |
| 3,353,511 | 11/1967 | Marino | 112/237 |
| 3,359,931 | 12/1967 | Millen et al. | 112/239 X |
| 3,371,632 | 3/1968 | Snyder et al. | 112/286 X |
| 3,614,935 | 10/1971 | Conti | 112/286 |
| 3,667,410 | 6/1972 | Bianchi | 112/239 X |
| 3,721,204 | 3/1973 | Schaffer et al. | 112/239 X |

*Primary Examiner*—Werner H. Schroeder
*Assistant Examiner*—Andrew M. Falik
*Attorney, Agent, or Firm*—Martin A. Farber

[57] ABSTRACT

A sewing machine with a thread cutting device, a pneumatic/automatic presser foot lifter and an air hose attached to the exhaust of the presser foot lift cylinder or its solenoid valve, the air hose directing the air flow to an air jet tube attached to the presser foot shaft behind the needle by a special holder with a single screw simultaneously holding the presser foot to the presser bar lifter. The presser foot lift cylinder and a solenoid valve connected thereto are mounted as a compact unit on a plate, with a piston of the lifting cylinder operatively disposed adjacent to a lifting angle bracket, the latter being connected to the lifting linkage inside the sewing machine. When the solenoid and lifting cylinder are released to lower the presser foot, the exhaust air from the cylinder is forced through the air jet tube up to its open end held by the holder for blowing the thread end above the presser foot.

9 Claims, 5 Drawing Figures

AUTOMATIC THREAD WIPER FOR SEWING MACHINES

BACKGROUND OF THE INVENTION

1. Field of the Invention

The invention relates to an automatic thread wiper for a sewing machine with a pneumatic/automatic presser foot lifter, with an air hose attached to the exhaust of the presser foot lifting cylinder directing the air flow to an air jet attached to the presser foot shaft behind the needle. When lowering the presser foot of such a device, the exhaust of the presser foot automatic cylinder is utilized to blow the end of the cut needle thread onto the top of the presser foot. When starting to sew again, the needle thread is pulled through the needle plate of the sewing machine.

2. Description of the Prior Art

For example from U.S. Pat. No. 3,614,935 and German Offenlegungsschrift 1,918,608, a device is known where the needle thread end is removed from underneath the presser foot on a sewing machine which is equipped with a thread cutting device. With such a device, the air jet flow is released in the immediate vicinity of the needle at the presser foot by a slanted bore drilled through the presser foot and directed to the underside of the presser foot, just before the presser foot is lowered completely onto the sewing material. The air jet is of such intensity that the thread end is blown upwardly from underneath the presser foot. According to the German publication the compressed air feeding channel also could open above the presser foot or needle bar.

The advantage of these systems is that the air pressure source is already available on machines with pneumatic presser foot devices. This German publication mentions that the air tube which is mounted close to the needle is attached to this air pressure source. The air jet generation has to be coordinated with the lowering of the presser foot movement of the piston rod of the presser foot cylinder, since the end of the thread has to be removed from the area underneath the presser foot sole before the presser foot is placed on top of the sewing material. This publication mentions advantages with the securing of machines which have pneumatic actuation devices for the presser foot. This publication mentions that the jet is suitably synchronized with the downward stroke, that it is synchronized with the compressed air movement in the pressure cylinder which causes the movement of the presser foot. No further teaching is provided.

Another device is known from U.S. Pat. No. 3,371,632, which device is also equipped with a pneumatic thread cutting device. The thread wiper consists of an air conduit, a manually activated needle valve and another air conduit which is attached to a rigid angle arm. This angle arm on its free end has two converging jet arms connected with fork-shaped jet-pipe pieces. The jet arms are directed toward the needle, diagonally downwardly towards the top of the material clamp plates from two sides, and the jet bounces off the clamp plates upwardly to raise the thread end, which is blown away upwards from the area underneath the clamp plates before placing the latter on top of the sewing material.

Another device is known from German Offenlegungsschrift No. 26 13 728. This device severs the thread chain from the stitching area of the material to be sewn on the machine, and is provided with a channel to dispose of the thread chain, an entrance to lead the thread chain into the channel, and a fixed and flexible knife in the area of the entrance connected with a piston of a pneumatic pulsator.

The above-mentioned devices are expensive requiring substantial modification either in the presser foot or in the particular formation of the conduits and its support. Furthermore none of these patents specify the necessary control for obtaining the jet flow at the optimum time during the lowering of the pressure foot, which also requires special design and expense associated therewith.

Conventional machines mount the solenoid valves and actuators for lifting the presser foot underneath the bed plate, which are separated in several units.

Accordingly it is an object of the present invention to improve the devices of the prior art and to provide an efficient device with as little expense as possible.

SUMMARY OF THE INVENTION

The present invention provides a hose and solenoid, and a pneumatic air cylinder actuator for lifting the presser foot, which are directly mounted as one unit in the back of a sewing machine on the arm above the bed plate, which utilizes the exhaust cylinder actuator to time the lifting of the thread end as the presser foot is lowered to start sewing.

As another feature of the present invention the air cylinders with the solenoid valves are combined into a compact unit.

Still in accordance with another feature of the invention this compact unit is mounted in a single base bracket in place of a cover which normally is used to close the opening of the arm of the sewing machine, which opening is normally provided on existing sewing machines for the purpose of assembling the machine.

The present invention utilizes the exhaust which is otherwise wasted at the solenoid valve which normally operates the pneumatic cylinder which in turn lifts the presser foot. Furthermore the present invention can provide a short hose for conducting the pressurized air, since it only extends a short distance from the back of the machine up to the pressure foot. Shorter hoses provide better operation, faster operation, less energy dissipation and more positive action on the thread. (The prior art required a large hose from underneath the machine extending all the way to the presser foot.)

Further according to the invention there is provided an efficient and inexpensive mounting of the exhaust end of the air tube on a sheet metal bracket using the same screw which already is present on sewing machines to normally fasten the presser foot of the machine into the presser bar. Simultaneously an optimumly directed air jet is provided at the best position for blowing the thread tail positively above the presser foot during the lowering thereof at the initiation of the sewing operation.

The above features of the present invention permit the mounting of the unit on existing machines, by mounting it above the bed plate of the machine. These features afford the shortest distance to the thread and blower connected to the presser foot, eliminating long air passages between the air cylinder and the associated solenoid valves. They also eliminate the necessity for drilling new mounting holes into the machine casting or presser foot.

The mounting of the unit at the above-mentioned opening of the arm cooperatively permits actuation of the piston of the presser foot lifting cylinder directly on the angle lifting bracket which is provided by the present invention. A simple mounting to the presser foot lifting linkage is provided by two screws and a wedge-shaped spacer with two holes. The bracket projects from the opening adjacent the piston of the pneumatic foot lifting cylinder.

In accordance with a further feature the present invention provides an air tube, having a free end contained in a holder which is fastened with the same screw which holds the presser foot and is mounted on top of the presser foot sole, the air flow through which is directed from behind the needle towards the operator. The other end of the air tube is connected to the exhaust of the foot lifting cylinder valve so that no special synchronization is necessary since the exhaust of the cylinder will only supply the air jet while the foot is descending.

Further a more positive action is achieved with the present invention compared to the known systems where the compressed air is conducted directly beneath the presser foot, and in practice the air will blow with the greatest intensity on the free end of the cut-off thread tail, that is the end furthest away from the needle eye, not necessarily lifting the entire thread tail above the presser foot.

In practice the air flow according to the present invention will start with the greatest intensity on the beginning of the thread tail near the needle eye, definitely and positively lifting the entire thread tail up and away from its normal position beneath the presser foot. Further almost any standard foot on any sewing machine can be used, without structural modification.

BRIEF DESCRIPTION OF THE DRAWING

With the above and other objects and advantages in view, the present invention will become more clearly understood in connection with the following detailed description of a preferred embodiment, when considered with the accompanying drawings, of which.

DETAILED DESCRIPTION OF THE PREFERRED EMBODIMENT

Figure 2:
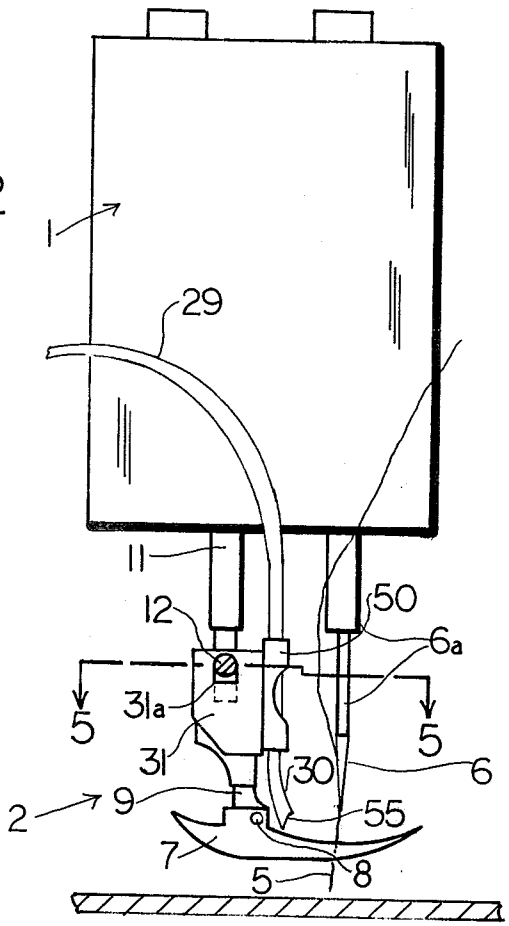
FIG. 2 is a side view of the sewing machine of FIG. 1.

Referring now to the drawings, a conventional sewing machine 1 is provided with a presser foot 2, the latter having a forked end 3 forming an opening 4 in which the thread tail 5 extends passing through the eye of a needle 6 mounted on the sewing machine via a needle bar *6a*. The presser foot 2 includes a lower pivotally mounted foot (sole) portion 7 about a pivot bar 8 which extends through an upper presser foot portion 9. The upper presser foot portion 9 is formed with an opening formed by and between U-shaped flanges 10. In this opening between the flanges 10, a presser bar 11 is secured to the upper presser foot portion 9 by means of a single threaded screw 12 passing through a slot *10a* in the upper presser foot portion 9 in the front between the flanges 10 and through a threaded bore *11a* in the presser bar 11. At the top the presser bar 11 is flanged outwardly in an enlarged upper portion 13 thereof and sits on top of a presser bar bushing 14, through which the central portion 15 of the presser bar 11 extends through a bore *14a* in the presser bar bushing 14. The presser bar bushing 14 is immoveably mounted in the sewing machine and is not illustrated in FIG. 2 for clarity.

The presser bar 11 is formed with a lifting lug 17 which is adapted to be engaged by a pivot lever 18 for lifting the presser bar 11. In this respect the presser bar 11 is longitudinally displaceably mounted for movement up and down within the presser bar bushing 14 and is biased downwardly by a spring (not shown), which spring is mounted between the presser bar 11 and the presser bar bushing 14. This spring itself causes the presser foot to lower and remain lowered when the lifting mechanism (hereinafter described) is deactivated.

Figure 1:
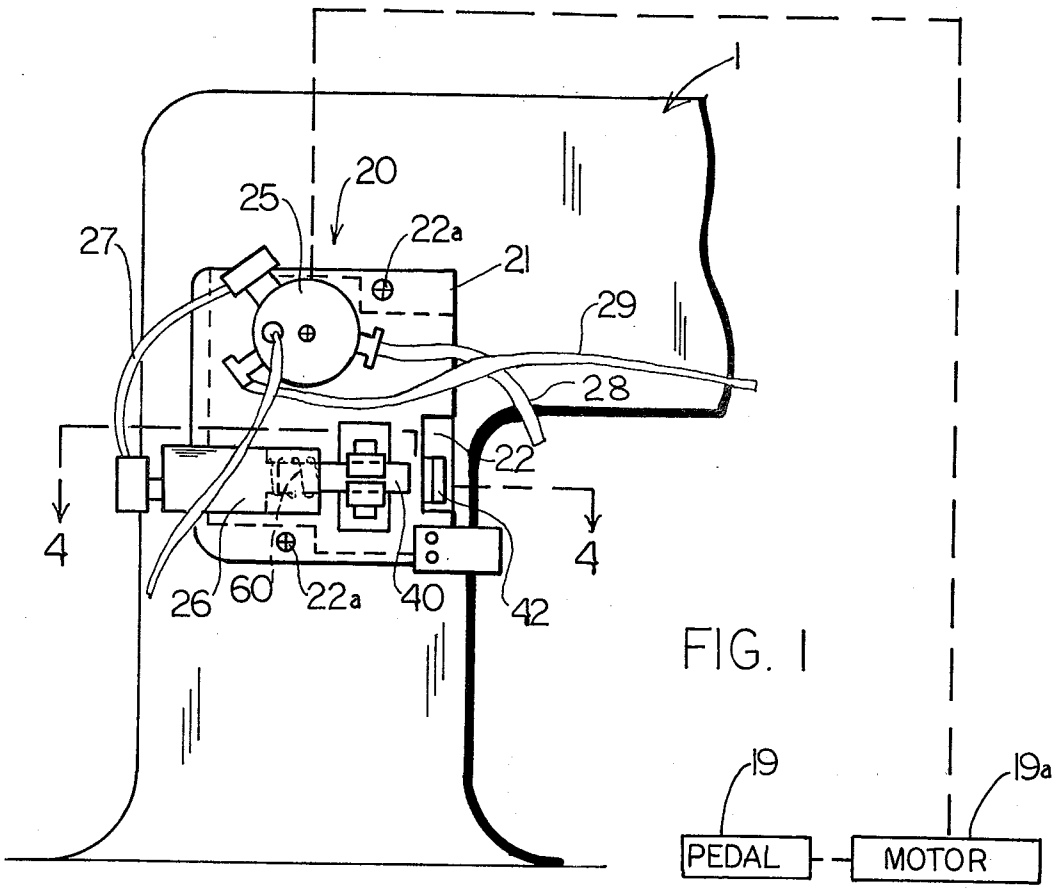
FIG. 1 is a view of the rear portion of a sewing machine on which the solenoid and lifting cylinder unit is mounted in accordance with the present invention, the sewing machine being partially broken away.

The above constitutes a normal arrangement for a sewing machine. Now, further in accordance with the teaching of the present invention, referring to FIG. 1, a unit 20 comprising a cast plate 21 (preferably aluminum) is mounted over an opening 22 in the back of the sewing machine on the arm above the bed plate. The plate 21 is fastened simply by means of screws *22a* to the machine, thereby substantially covering the opening 22. A solenoid valve 25 and a pneumatic lifting cylinder 26 are mounted on the plate 21. Although not shown an oiler and regulator known per se can also be mounted on the plate 21. The solenoid valve 25 is connected to the lifting cylinder 26 by a tube 27 and a pressurized source of air (not shown) is connected to the solenoid valve via a tube 28. In operation the exhaust of the cylinder 26 passes through the tube 27 to the solenoid valve 25 and from there is connected via a tube 29 which extends across the machine and is mounted on its free end 30 (FIGS. 2 and 3) by means of the bracket holder 31 in accordance with the present invention terminating directly adjacent the thread end 5 near the opening 4 above the presser foot 2.

Figure 3:
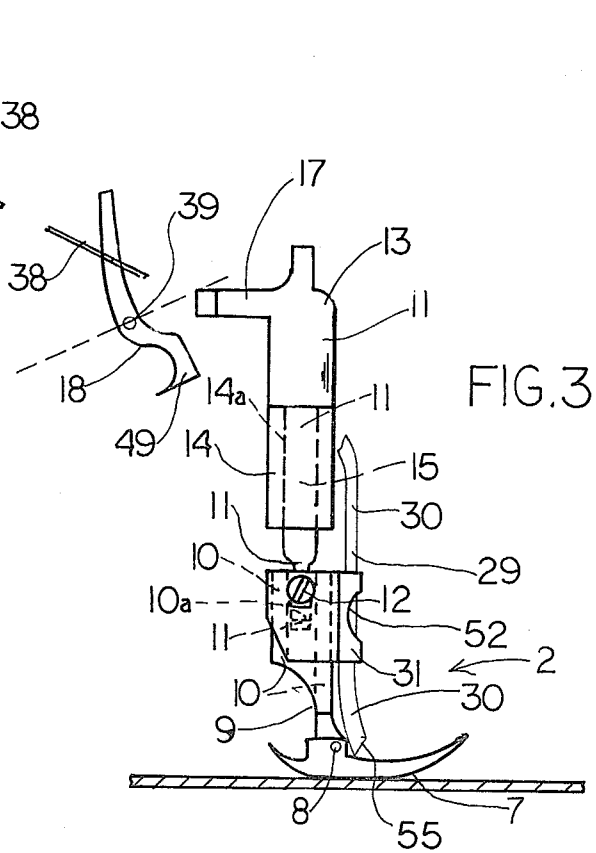
FIG. 3 is a view of the presser foot attachment similar to that of FIG. 2 but further showing the lifting linkage.
Figure 4:
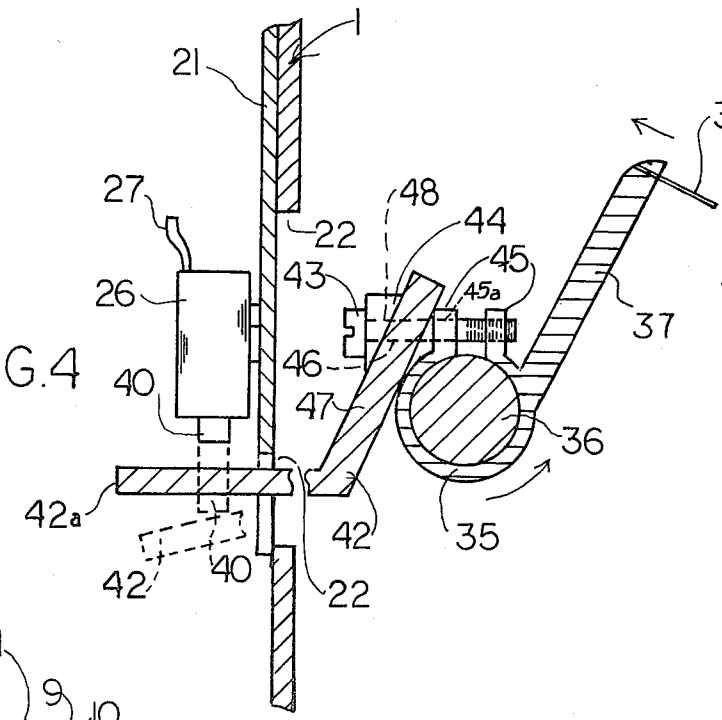
FIG. 4 is a sectional view taken along the lines 4—4 of FIG. 1 showing an initiating portion of the linkage connecting to FIG. 3.
Figure 5:
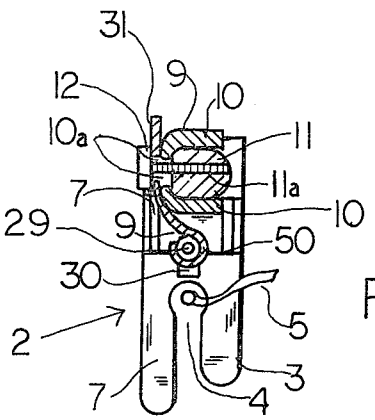
FIG. 5 is a section taken along the lines 5—5 of FIG. 2.

Inside the sewing machine adjacent the arm opening 22 a crank 35 is secured to a cylindrical bar 36 which is pivotably mounted in the sewing machine. The crank 35 constituting a clamping member is formed with an arm 37 which is pivotably connected to a wire 38, the latter being connected to the pivot arm 18 illustrated in FIG. 3. The pivot arm 18 is pivotally mounted in the machine about a pivot axis 39, such that when the crank 35 and bar 36 are turned as indicated by the curved arrow in FIG. 4, the arm 37 causes the wire 38 to move to the left thereby pivoting the pivot arm 18 upwardly and engaging the pawl 49 thereof under the lug 17 of the presser bar 11, thereby raising the presser foot 2 secured to the presser bar 11 by means of the screw 12.

The actuation of this pivotal movement of the crank 35 and bar 36 is brought about in the present invention by means of the pneumatic lifting cylinder 26 which is operatively connected to the pedal 19 of the machine via a special commercially available clutch-motor *19a* (mounted underneath the table top of the machine) and having outlets for foot lifting and back tacking, such that when the operator lifts the pedal 19 the motor outlet gives a signal to the solenoid valve 25 and in turn pneumatic cylinder 26 is actuated to lift the presser foot. However with the present invention a special actuation is provided in the manner that the piston 40 of the pneumatic lifting cylinder 26 is operatively positioned adjacent a lifting angle bracket 42 which extends through the opening 22 (FIGS. 1 and 4) of the sewing machine and is secured on its interior end by means of at least one screw 43 and a wedge 44 to the flanges 45 of the crank 35. The screw(s) 43 is threaded only into a threaded bore in the interior most flange 45 of the crank 35, and passes simply through the non-threaded bores 45*a* and 48 in the other flange of the crank and the wedge member 44, respectively, and a non-threaded bore 46 in the angle lever 42. Preferably two bore holes are formed in the crank flanges, the wedge 44 and the interior arm 47 of the angle bracket 42. The wedge 44 insures a good mounting of the bracket 42 to the crank 35 and the elongated screw(s) 43 simultaneously secures the clamping of the crank 35 to the pivot bar 36.

Upon actuation of the lifting cylinder 26 (by the pedal 19) for lifting, the actuator or piston 40 extends and pushes against the projecting arm 42*a* of the lifting angle bracket 42, thereby rotating the crank 35 counterclockwise causing the lifting of the presser foot 2 as described above. In the position illustrated in FIGS. 3 and 4, the presser foot 2 has not yet been lifted, which is the operating position of the sewing machine. In FIG. 2, the presser foot 2 is illustrated in the lifted position, that is the dashed position of the piston 40 and bracket 42 in FIG. 4.

In accordance with the present invention a simple sheet metal holder 31 is mounted by the same screw 12 which normally only secures the upper part 9 of the presser foot 2 to the presser bar 11, with the holder plate 31 abutting between the head of the screw 12 and the front of the upper portion 9 of the presser foot 2. The holder plate 31 is formed with a slot 31*a* for longitudinal adjustment relative to the screw 12 which extends therethrough.

The front of the holder 31 is rolled-in forming a tubular portion 50 through which the lower portion 30 of the air tube 29 is fixedly mounted. The tubular portion 50 is parallel to the upper portion 9 of the presser foot and the presser bar 11 and the end 30 of the air tube 29 likewise extends parallel to these parts. The rolled-in portion 50 is preferably formed with a substantially eliptical opening 52 so that the tube end 30 is clamped only at the upper and lower portions of the rolled-in portion 50 of the holder plate 31. The open free end 55 of the air tube 30 is cut approximately 45° with respect to the longitudinal direction of the air tube 30 so that the opening faces the top or beginning of the thread tail 5 (herein the term thread tail is the entire cut-off end portion beginning from the needle 6), directing a slight downwardly yet substantially horizontally air jet impingement on the beginning of the thread tail 5 in a direction towards the operator, with the jet also abutting and bouncing off the upper portion of the lower part (i.e., the presser foot sole) 7 of the presser foot 2, causing the optimum burst of air to lift the thread upwardly through the opening 4 as the presser foot begins its descent before the initiation of the sewing operation.

The operation of the solenoid valves in connection with the pneumatic cylinder per se is well known and will not be described in detail. Particularly solenoid valves and pneumatic lifting cylinders are known in connection with conventional arrangements mounted underneath the bed plate of the sewing machine, to cause the lifting of the presser foot directly via the crank 35 and knee lifter shaft 36 and the remaining conventional lifting linkage (37, 38, 39, 17) as described above to raise the presser bar lifter 11 and the presser foot 2. The present invention however provides a compact new arrangement of the plate unit 21 containing the pneumatic cylinder 26 and solenoid 25 and the new lifting angle bracket 42 cooperating directly with the piston 40 and the accompanying shorter length of the air tube 29 as well as also the simple air tube mounting holder 31, and ease of adaptation thereof for use with existing machines.

The screws 43 alone suffice to mount the lifting angle bracket 42 to the crank 35. The angle lifting bracket 42 of the present invention takes over the function of the known knee lifter and does it automatically. The present invention can adapt the lifting angle bracket 42 to a pressed steel crank 35 and for this, for example, only one screw is necessary with the same construction of the bracket.

In operation, the operator presses on the pedal 19 during the sewing operation. After sewing, the operation is stopped by lifting the foot off the pedal. This stops the machine and the motor 19*a* automatically activates the solenoid valve 25 causing the automatic lifting of the presser foot 2 by the foot lift air cylinder 26 and the extension of the piston 40 as described above turning the angle lifting lever bracket 42 and the lifting linkage. This extended position of the piston 40 is held by the cylinder 26 which is filled with pressurized air and the solenoid valve 22 against the biasing of the spring 60 in the cylinder, which holds the presser foot 2 up in the position of FIG. 2 until the sewing operation again is to begin. In the position of FIG. 2 with the presser foot up, the solenoid valve 26 remains open to communicate the pressurized source of air and the air pressure in the cylinder 26 keeps the piston 40 extended. Pressing on the floor pedal 19 immediately starts the lowering operation of the presser foot and the deactivation of the solenoid valve permitting the air from cylinder 26 to exhaust.

When the sewing operation begins, the operator presses on the floor pedal 19 which deactivates or releases the solenoid valve 25 and permits air from the cylinder 26 to be exhausted therethrough, since the action of the spring 60 on the piston 40 now can cause the retraction of the piston 40 and forces the exhaust air through the tube 27, the valve 25 and into the air tube 29, which air then jets out the end opening 55 thereof at the top of the presser foot sole 2 and blows the thread tail 5 and its end upwardly above the opening 4, so that it is out of the way for the initiation of sewing. The pressing of the operator's foot on the foot pedal per se as is known in other solenoid-pneumatic cylinder foot lifters causes the deactivation of the solenoid valve 25 by providing a signal to the solenoid valve 25 to control flow out of the foot lift air cylinder 26 and via the cylinder spring 60 to retract the piston 40, whereby the presser foot 2, which is spring-biased in a downward direction, lowers itself. Accordingly, automatically and simultaneously in accordance with the present invention as the presser foot 2 is lowered, the air jet blows the thread tail upwardly. Extra timing mechanisms are not required since a perfect synchronization is provided.

For assembly mounting of the lifting angle bracket 42, in the opening 22, the normal cover is first removed. Then the screws 43 and the wedge-shaped spacer 44 are inserted. The foot-lifting plate unit 21 is then placed on the machine in place of the usual back cover, using the screws 22*a*.

In normal operation without the device of the present invention, the action of the operator via a knee lifter and lever is mechanically transferred to the knee lifter shaft 36 to cause its turning; and then, via the remaining conventional lifting linkage 35, 37, 38, 39, 17, the presser bar 11 and the presser foot 2 are lifted as described above. The present invention instead actuates the cylinder 26, which by means of the piston 40, moves the lifting angle bracket 42 to turn the crank 35. The present invention uses essentially the same screws 43, however somewhat longer than that which normally exist to connect the crank 35 to the knee lifter shaft 36. The arrangement and operation of the present invention eliminates the conventional knee lifter operation.

With the holder 31, 50, the air blower tube end 30 is positioned to bring the thread up with security. With the synchronization and operation and positioning of the air tube end 30 in accordance with the present invention, as the presser foot 2 descends, simultaneously the air jets out the tube opening 55 at the position closest to the needle 6 by lifting the tail 5 of the thread. An automatic synchronization of blowing at this time occurs without any additional equipment since the air exhaust starts at the moment of the foot descent when the pneumatic cylinder 26 is released to permit the descent. Furthermore the greatest intensity is at the beginning because the cylinder 26 is full at that moment and the air jet attacks the beginning of the thread tail, i.e., the thread portion closest to the needle first and then the entire thread tail up to its very end. The holder 31 and air tube end 30 directs the air jet not at the very remote bottom end of the thread tail 5 but at the upper beginning portion (starting from the needle 6) of the tail of the thread tail 5, thereby insuring positive blowing of the thread upwardly through the opening 4 in the presser foot 2. (This is completely different from the U.S. Pat. No. 3,614,934 and German Offenlegugsschrift 1,918,608. The U.S. patent to the contrary blows on the very remote bottom end of the thread tail which is under the presser foot and the air jet does not reach the upper beginning of the thread tail which beginning is at the eye of the needle above the presser foot.) When the operator presses the pedal 19 and actuates the solenoid valve 25 for lowering the presser foot, the solenoid valve 26 closes its pressurized air intake and simultaneously opens the exhaust. Then the spring 60 retracts the piston 40 and forces the exhaust air outwardly with great intensity causing the air to go through the air tube 29 and to exit at the directed opening 55 causing the thread tail 5 to move up through the opening 4 between the fork 3 of the presser foot 2.

While I have disclosed one embodiment of the invention, it is to be understood that this embodiment is given by example only and not in a limiting sense.

I claim:

1. A thread wiper for a sewing machine, comprising a compact unit adapted to be mounted on the back of an arm of a sewing machine and including a spring biased pneumatic cylinder having a piston, and a solenoid valve operatively connected to said pneumatic cylinder, a downwardly biased presser foot, linkage means mounted in the sewing machine for lifting said presser foot upon actuation thereof, means for actuating said linkage means via extension of said piston in said pneumatic cylinder upon stopping stitching operation of the sewing machine, a needle having an eye and thread extending therethrough, said needle being mounted in said sewing machine, said thread having a thread tail beginning at the eye of the needle and extending between said presser foot to a cut-off thread end therebelow when said presser foot is in a lifted position, a holder mounted on said presser foot, an air jet tube connected from said solenoid valve to said holder means and extending to an open free end of said air jet tube at an upper portion of the sole of said presser foot adjacent and facing said thread tail, means for deactivating said solenoid valve and retracting said piston in said pneumatic cylinder, and releasing said actuating means, so that said downwardly biased presser foot is released and descends, and simultaneously the exhaust from said pneumatic cylinder jets through said air jet tube, exiting at said open free end thereof, lifting said entire thread tail including said cut-off thread end above the presser foot so that the thread tail is out of the way for the initiation of sewing.

2. The thread wiper as set forth in claim 1, wherein said open free end of said air jet tube is mounted on top of the sole of said presser foot, and is directed from behind the needle towards an operator of the sewing machine.

3. The thread wiper as set forth in claim 1, wherein said linkage means includes a presser bar, and a single screw connects said presser bar, said presser foot and said holder.

4. The thread wiper as set forth in claim 3, wherein said holder constitutes a substantially flat sheet metal portion formed with an elongated slot through which said single screw extends, the latter having a head abutting said flat sheet metal portion, the latter in turn abutting said presser foot, said holder includes a front rolled-in portion forming a tube extending substantially parallel to said presser foot and said presser bar, an end of said air jet tube extends through said rolled-in portion, said end of said air jet tube having at the bottom thereof said open free end.

5. The thread wiper as set forth in claim 4, wherein said rolled-in portion is formed with a substantially eliptical opening exposing a portion of said end of said air jet tube.

6. The thread wiper as set forth in claim 1, wherein said actuating means constitutes a lifting angle bracket secured to said linkage means and having a projection extending operatively adjacent said piston.

7. The thread wiper as set forth in claim 6, wherein said linkage means includes a rotatably mounted crank having flanges formed with threaded bores, said lifting angle bracket is formed with an inner arm having at least one non-threaded bore aligned with said threaded bores of said flanges, respectively, of said crank, a wedge having a non-threaded bore aligned with said non-threaded bore of said inner arm of said lifting angle bracket, said inner arm of said lifting angle bracket being disposed flush against said wedge and abutting one of said flanges of said crank, screw means extending through the aligned said non-threaded bores respectively of said wedge and said inner arm of said lifting angle bracket and threaded into engagement in said threaded bores of said flanges of said crank, said screw means extends substantially parallel to said projection of said lifting angle bracket.

8. The thread wiper as set forth in claim 1, wherein said compact unit includes a single base bracket plate, said solenoid valve and said pneumatic cylinder are mounted on said single base bracket plate, an arm of the sewing machine is formed with an opening in the back, said single base bracket plate is mounted on said arm substantially covering said opening, whereby the air jet tube from said solenoid is of minimum length.

9. The thread wiper as set forth in claim 1, further comprising spring biasing means, said piston of said pneumatic cylinder is adapted to be held by pressurized air in the extended position in said pneumatic cylinder upon the stopping stitching operation of the sewing machine against said spring biasing means, said spring biasing means for retracting said piston when said solenoid valve is deactivated by said deactivating means and for exclusively providing said exhaust from said pneumatic cylinder to jet through said jet tube.

* * * * *